United States Patent [19]

Wolf

[11] 4,406,271

[45] Sep. 27, 1983

[54] CAPACITOR DISCHARGE IGNITION SYSTEM AND METHOD OF MANUFACTURE THEREOF

[75] Inventor: Ronald J. Wolf, Zanesville, Ind.

[73] Assignee: Wabash, Inc., Wabash, Ind.

[21] Appl. No.: 321,476

[22] Filed: Nov. 16, 1981

Related U.S. Application Data

[60] Division of Ser. No. 171,705, Jul. 24, 1980, Pat. No. 4,333,442, which is a continuation-in-part of Ser. No. 105,234, Dec. 19, 1979, abandoned.

[51] Int. Cl.[3] ..... F02P 1/00

[52] U.S. Cl. ..... 123/599; 123/634; 123/601; 123/149 R

[58] Field of Search ..... 123/599, 634, 600, 601, 123/602, 603, 149 A, 149 D, 650, 652

[56] References Cited

U.S. PATENT DOCUMENTS

| | | | |
|---|---|---|---|
| 3,517,655 | 6/1970 | Jaulmes | 123/599 |
| 3,941,110 | 3/1976 | Sekiguchi | 123/599 |
| 4,036,201 | 7/1977 | Burson | 123/599 |
| 4,120,277 | 10/1978 | Ehlen | 123/634 |
| 4,248,201 | 2/1981 | Tsutsui | 123/634 |

*Primary Examiner*—Ronald B. Cox
*Attorney, Agent, or Firm*—Mason, Kolehmainen, Rathburn & Wyss

[57] ABSTRACT

A capacitor discharge ignition system is provided in a self-contained hermetically sealed housing having improved component packaging. The capacitor discharge ignition system includes an ignition coil and an auxiliary coil for charging a capacitor of the capacitor discharge ignition system in response to a rotating magnetic field. The auxiliary coil is fabricated with a coil shape factor having a greater height and lower mean turn diameter than conventional auxiliary coils. The lower mean turn diameter of the auxiliary coil provides space within the housing for circuit components of the capacitor discharge ignition system to be placed between the auxiliary coil and the inner wall of the housing. Thus, the circuit components are removed from the conventional location between the primary and secondary windings of the ignition coil. The removal of the circuit components from the ignition coil assembly provides an improved ignition coil with increased coupling to allow the ignition coil to be fabricated with less coil wire and a smaller volume than conventional coils. The improved ignition coil is thus fabricated with a narrower height factor. A capacitor discharge ignition system is also provided having a dual secondary ignition coil arrangement for operation with two cylinder engines. In an alternate arrangement, the circuit components are mounted on a printed circuit board above the narrowed height ignition coil. In both arrangements, the gain in volumetric space in the housing is utilized either for the integration of additional components or to reduce the overal size of the capacitor discharge ignition system relative to conventional capacitor discharge ignition systems having the same volume of integrated circuit components.

10 Claims, 18 Drawing Figures

CAPACITOR DISCHARGE IGNITION SYSTEM AND METHOD OF MANUFACTURE THEREOF

CROSS-REFERENCE TO RELATED APPLICATION

This is a division, of application Ser. No. 171,705, filed July 24, 1980, now U.S. Pat. No. 3,333,442, which is a continuation-in-part of co-pending application Serial No. 105,234 filed on December 19, 1979 and now abandoned.

BACKGROUND OF THE INVENTION

A. Field of the Invention

The present invention relates generally to capacitor discharge ignition systems and more paritcularly to an improvement in component packaging and coil arrangements of a capacitor discharge ignition system.

B. Description of the Prior Art

Various capacitor discharge systems of the prior art have been developed to provide a breakerless ignition system for the control of an engine whereby an appropriately timed signal is supplied to the primary winding of an ignition coil to induce a high voltage in a secondary winding of the ignition coil to fire a spark plug or spark plugs associated with the engine.

The capacitor discharge systems of the prior art utilize various circuit arrangements and coil arrangements including triggering and charging coils in combination with a rotating permanent magnet on the engine flywheel to induce voltage in a charging coil, charge a capacitor with the induced voltage and discharge the capacitor into the primary winding of an ignition coil. Such arrangements are shown for example in U.S. Pat. No. 3,941,111 which issued to T. F. Carmichael on Mar. 2, 1976; U.S. Pat. No. 4,056,088 which issued to T. F. Carmichael on Nov. 1, 1977; U.S. Pat. No. 4,036,201 which issued to B. O. Burson on July 19, 1977; and co-pending application Ser. No. 14,141 filed on Feb. 22, 1979 by Ronald J. Kiess.

A capacitor discharge ignition system manufactured by Wabash, Inc., the assignee of the present application, is illustrated in FIGS. 1 and 2. Briefly, the capacitor discharge ignition system includes an auxiliary winding 2 wound on a widened base section 4*a* of a coil support 4. A primary winding 6 of an ignition coil is wound on a narrowed upstanding section 4*b* of the coil support 4 with the primary winding 6 above the auxiliary winding 2. Various circuit components are disposed and mounted about the primary winding 6. A secondary winding 8 of the ignition coil is disposed over the circuit components and the primary winding 6.

The completed assembly as shown in FIG. 2 is enclosed in a cup-shaped housing and potted. The various electrical connections generally referred to at 9 are utilized to connect the capacitor discharge ignition system to the engine to be controlled.

As shown in FIG. 2, various circuit components of the capacitor discharge ignition system are mounted within the capacitor discharge housing assembly. However, due to packaging efficiency requirements as dictated by engine design and OEM specifications, some circuit components, such as a charging capacitor 7 are mounted externally to the overall capacitor discharge ignition housing assembly and connected to the other circuit components by one of the leads of the cable connections 9. The high tension secondary connector 5 is shown in FIGS. 1 and 2 for connection to a spark plug through a suitable cable.

While the above-described capacitor discharge ignition system of FIGS. 1 and 2 is generally suitable for its intended purpose, it would be desirable to increase the packaging efficiency of capacitor discharge ignition systems in order to either reduce the overall volume thereof or provide additional integrated circuit components while maintaining or improving operational characteristics. The reduction in overall volume of the capacitor discharge ignition system housing is beneficial to allow reduced overall size of the apparatus incorporating the engine such as small and lightweight chain saws or power mowers. Further, it is also advantageous to incorporate all circuit components of the capacitor discharge ignition system within a sealed housing enclosure for ease of assembly, long life and desirable operating characteristics.

The capacitor discharge ignition system disclosed in U.S. Pat. No. 4,036,201 utilizes a relatively large E-shaped core in a cup-shaped housing to mount the circuit components of the capacitor discharge ignition system. The cup-shaped housing includes an ignition coil with primary and secondary windings as shown in FIG. 3 with the overall diameter of the ignition coil being substantially less than the diameter of the cup-shaped housing. The auxiliary coil is mounted above the ignition coil and as illustrated in FIG. 3 therein is of smaller diameter than the ignition coil with substantial amounts of free volume space within the cup-shaped housing. Electrical circuit components of the capacitor discharge ignition system are mounted about the ignition coil and between the ignition coil and the cup-shaped housing. The arrangement of FIG. 3 does not appear to be designed for maximum volumetric efficiency in packaging of the capacitor discharge ignition system but instead appears to be based on the required dimensions of the E-shaped core. Thus, the capacitor discharge ignition system of U.S. Pat. No. 4,036,201 exhibits large, unused volumetric space within a housing and is not designed for maximum space efficiency and minimum size of the overall capacitor discharge ignition system housing assembly.

While the above-described capacitor discharge ignition systems of the prior art are generally suitable for their intended use, it would be desirable to provide a capacitor discharge ignition system with optimum volumetric space utilization while minimizing the overall dimensions of the capacitor discharge ignition system housing and while maintaining desired operational characteristics.

SUMMARY OF THE INVENTION

Accordingly, it is a principal object of the present invention to provide a capacitor discharge ignition system with optimized volumetric space utilization to minimize the overall dimensions of the capacitor discharge ignition system while providing integration of all circuit components and reduced cost of manufacture.

It is another object of the present invention to provide a capacitor discharge ignition system with an improved coil arrangement wherein the auxiliary winding for charging a capacitor is fabricated having a shape factor that is a marked departure from auxiliary windings of the prior art and wherein the volume of the ignition coil is reduced to provide optimum packaging of the circuit components of the capacitor discharge ignition system.

It is a further object of the present invention to provide a capacitor discharge ignition system for two cylinder engine operation with a dual secondary ignition coil and an improved coil arrangement wherein the auxiliary winding for charging a capacitor is fabricated having a shape factor that is a marked departure from auxiliary windings of the prior art to provide optimum packaging and volumetric efficiency of the capacitor discharge ignition system.

In accordance with the present invention, it has been found that the shape factor of conventional auxiliary windings may be modified contrary to the general teachings of the prior art. For example, the general teachings of the prior art as evidenced by conventional auxiliary windings in capacitor discharge ignition systems exhibit auxiliary windings of rather large diameters and narrow height factors to enable the auxiliary winding to be positioned in its entirety rather closely to the path of the rotating magnet carried by the engine flywheel. Further, conventional auxiliary windings utilize relatively heavy gauge wire.

As discussed in connection with FIGS. 1 and 2, capacitor discharge ignition systems of the prior art that have been fabricated to maximize space efficiency and minimize the overall volume of the capacitor discharge ignition system utilize a large diameter and narrow height factor auxiliary winding with the circuit components mounted between the primary and secondary windings of an ignition coil.

It is believed that the prior art capacitor discharge ignition systems have avoided changing the shape or form factor of the auxiliary coil based on the principle that increasing the height of the auxiliary winding would degrade flux linkage to the core and also aggravate leakage problems. Thus, the narrow height factor of conventional auxiliary windings has been utilized to maintain the auxiliary winding in close proximity to the rotating magnet path.

However, in accordance with the principles of the present invention, it has been found that by the use of smaller gauge wire and an increased height factor of the auxiliary winding and narrower diameter than that of conventional auxiliary windings, the mean turn diameter of the auxiliary winding is decreased and optimized for flux linkage and decreased leakage problems. Thus, the mean turn diameter of the auxiliary winding of the present invention results in a mean turn diameter that is closer to the core than conventional auxiliary windings to achieve desirable flux linkage characteristics in spite of the increased height of the auxiliary winding and resultant increased mean turn distance from the magnet path.

Briefly, these and other objects of the present invention are achieved by providing a self-contained hermetically sealed housing having improved component packaging. The capacitor discharge ignition system includes an ignition coil and an auxiliary coil for charging a capacitor of the capacitor discharge ignition system in response to a rotating magnetic field. The auxiliary coil is fabricated with a coil shape factor having a greater height and lower mean turn diameter than conventional auxiliary coils. The lower mean turn diameter of the auxiliary coil provides space within the housing for circuit components of the capacitor discharge ignition system to be placed between the auxiliary coil and the inner wall of the housing. Thus, the circuit components are removed from the conventional location between the primary and secondary windings of the ignition coil. The removal of the circuit components from the ignition coil assembly provides an improved ignition coil with increased coupling to allow the ignition coil to be fabricated with less coil wire and a smaller volume than conventional coils. The improved ignition coil is thus fabricated with a narrower height factor. A capacitor discharge ignition system is also provided having a dual secondary ignition coil arrangement for two cylinder engine operation. In an alternate arrangement, the circuit components are mounted on a printed circuit board above the narrowed height ignition coil. In both arrangements, the gain in volumetric space in the housing it utilized either for the integration of additional components or to reduce the overall size of the capacitor discharge ignition system relative to conventional capacitor discharge ignition systems having the same volume of integrated circuit components.

These and other objects of the present invention will become apparent from the accompanying detailed description taken in conjunction with the accompanying drawings.

DESCRIPTION OF THE PREFERRED EMBODIMENT

Figure 3:
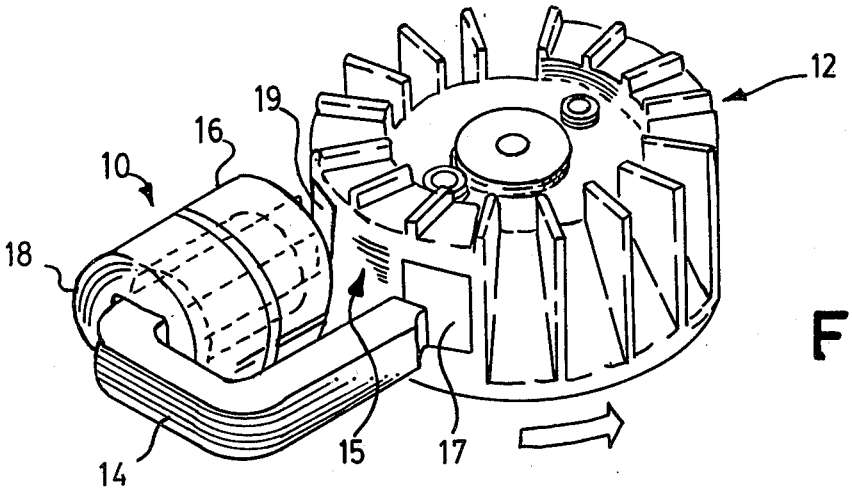
FIG. 3 is a perspective representation of the capacitor discharge ignition system of the present invention in operation adjacent a flywheel of an engine.
Figure 4:
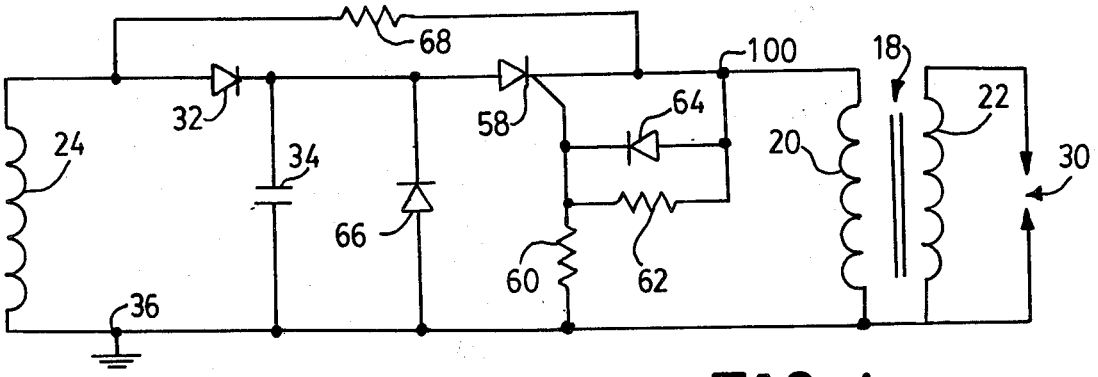
FIG. 4 is an electrical schematic diagram of one preferred circuit arrangement of the capacitor discharge ignition system embodying the concepts of the present invention as shown in FIG. 3.
Figure 5:
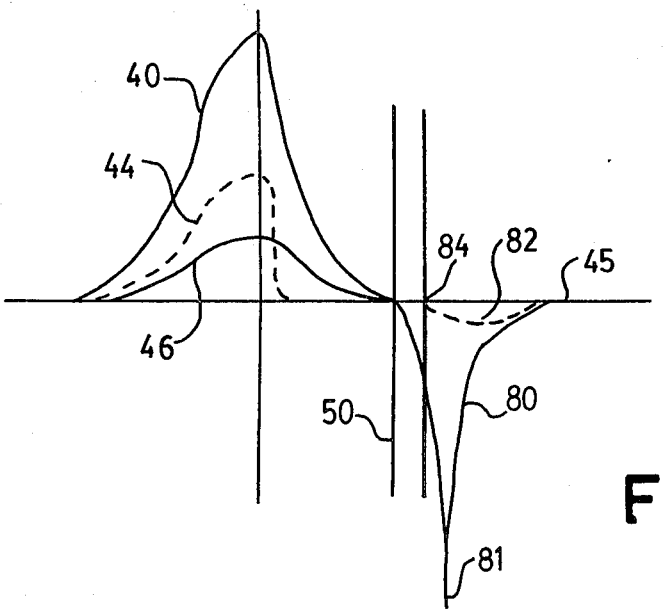
FIG. 5 is a graphical representation of the voltage and current waveforms present during the operation of the capacitor discharge ignition system of FIG. 4.

Referring now to the drawings and more particularly to FIGS. 3 through 5, the capacitor discharge ignition (CDI) system of the present invention referred to generally at 10 is shown in operative position adjacent a flywheel 12 of an engine. The flywheel 12 carries a permanent magnet referred to generally at 15 that energizes and controls the basic timing of the CDI system 10 upon rotation of the flywheel 12. The permanent magnet 15 includes two magnet pole faces or pieces 17 and 19. The CDI system 10 includes a generally U-shaped stator core 14. An auxiliary coil 16 and an ignition coil 18 are disposed on one leg of the stator core 14.

Referring now additionally to FIG. 4, the ignition coil 18 includes a primary winding 20 and a secondary winding 22. The auxiliary coil 16 includes an auxiliary winding 24. The primary winding 20 and the secondary winding 22 are concentrically arranged on the stator core 14 with the auxiliary coil 16 disposed along the stator core 14 adjacent the ignition coil 18.

The ignition coil 18 of the CDI system 10 of the present invention is arranged to fire a spark plug generally indicated at 30 and connected across the secondary winding 22. It should also be understood that the secondary winding 22 in other arrangements is connected to a plurality of spark plugs through an appropriate distributor system. The auxiliary winding 24 at one end referred to at reference point 42 is connected through a diode 32 anode to cathode to one end of a charging capacitor 34. The other end of the capacitor 34 and the other end of the auxiliary winding 24 are connected to a ground reference indicated generally at 36.

During operation of the CDI system 10 and referring now additionally to FIG. 5 as the leading magnet pole 17 of the permanent magnet 15 on the rotating flywheel 12 approaches the stator 14, a voltage is induced in the auxiliary winding 24 represented graphically by the waveform 40. The voltage waveform 40 is referenced to the coil end 42 of the auxiliary winding 24. A corresponding current represented by the waveform 44 of FIG. 5 flows through the diode 32 to charge the capactior 34. As the leading magnet pole 17 leaves the proximity of the stator core 14, the induced voltage in the auxiliary winding 24 and the corresponding current flowing into the capacitor 34 will decrease as shown by the respective waveforms 40 and 44 in FIG. 5. Due to the presence of the diode 32, the charge on the capacitor 34 will be retained. As the leading magnet pole 17 moves past the stator core 14, a voltage will also be induced in the primary winding 20 of the ignition coil 18 as represented by the waveform 46 in FIG. 5.

The reference line 50 in FIG. 5 represents the respective points of the waveforms 40, 44 and 46 at the time of operation during rotation of the flywheel 12 as the leading magent pole 17 passes away from the stator core 14 and before the arrival of the trailing magnet pole 19 of the permanent magnet 15. While the vertical axis or ordinate of the graphical representation of FIG. 5 represents the magnitude of the voltage or current of the respective waveforms 40, 44 and 46, the horizontal axis or abscissa 45 represents the angular rotation of the flywheel 12. As the trailing pole 19 of the permanent magnet approaches the stator core 14, the polarity of the induced voltage in the auxiliary winding 24 reverses and a voltage is induced of the opposite polarity with respect to the coil end 42 of the auxiliary winding 24.

Referring again to FIG. 4, the primary winding 20 is connected between the ground reference 36 and the cathode of a discharging control SCR 58 identified at reference point 100. The junction of the charging capacitor 34 and the cathode of diode 32 is connected to the anode of the discharging control SCR 58. The gate or control electrode of the discharging control SCR 58 is connected through a resistor 60 to the ground reference 36. The gate or control electrode of the SCR 58 is also connected through a resistor 62 to the cathode of the SCR 58. The resistors 60 and 62 provide a triggering network for the SCR 58. A protection diode 64 is connected anode to cathode between the cathode and gate of the SCR 58 to prevent excessive reverse breakdown voltages across the cathode to gate junction of the SCR 58.

A limiting diode 66 is connected anode to cathode between the ground reference 36 and the anode of the SCR 58 to shunt high voltage ringing after the discharge of the capacitor 34 and to protect the diode 32 from excessive reverse voltages.

A resistor 68 is connected between the coil end 42 of the auxiliary winding 24 and the cathode of the SCR 58 to provide a triggering path from the auxiliary winding 24 and the gate to cathode junction of the SCR 58 and also to control high voltage ringing after discharge of the capacitor 34 and to protect the diode 32 from excessive reverse voltages. The resistor 68 in addition to achieving timing control by the auxiliary winding 24 functions in combination with the limiting diode 66 to achieve high output voltages at 30 while preventing excessive reverse voltages across the diode 32.

In the arrangement of FIG. 4, the primary winding 20 and the auxiliary winding 24 are arranged to have induced voltages of a common polarity with respect to the coil end 42 of the auxiliary winding 24 and the coil end 100 of the primary winding 20.

Referring now to FIG. 5 and considering the operation of the CDI system 10, as the trailing magnet pole 19 of the permanent magnet 15 passes the stator core 14, a voltage is induced in the auxiliary winding 21 as represented by the waveform 80. The induced voltage in the auxiliary winding 24 decreases sharply to a negative peak 81 as the trailing pole 19 is approximately positioned adjacent the stator core 14. As the trailing magnet pole 19 leaves the vicinity of the stator core 14, the induced voltage waveform 80 returns toward the base line 45. Thus, as the trailing magnet pole 19 moves through the vicinity of the stator core 14, a negative voltage is induced across the auxiliary winding 24 at the coil end 42 with respect to the reference potential 36, represented graphically by the base line axis 45. The charge capacitor 34 is isolated by the diode 32 and the charge across the capacitor 34 is maintained until the SCR 58 is triggered.

Accordingly, with the capacitor 34 isolated from the auxiliary winding 24, the remaining circuit is highly inductive and the resultant current flowing from the auxiliary winding 24 and represented by waveform 82 of FIG. 5 appreciably lags the voltage waveform 80. As the voltage represented by the waveform 80 is induced across the auxiliary winding 24, the resultant current represented by the waveform 82 flows through the series combination of the resistor 60, the gate to cathode junction of the SCR 58, and the resistor 68. The SCR 58 is triggered when the appropriate combination of triggering voltage and triggering current are simultaneously present across the gate to cathode junction of the SCR 58. Upon triggering of the SCR 58, the capacitor 34 is discharged into the primary winding 20 of the ignition coil 18. The discharge of the capacitor 34 that occurs through the primary winding 20 induces a high voltage pulse in the secondary winding 22 of the ignition coil 18 to provide the appropriate power conditions to fire the spark plug connected at 30 across the secondary winding 22. The point of angular revolution of the flywheel 12 at which the triggering of the SCR 58 occurs is indicated by the reference line 84. The auxiliary winding 24 determines the ignition timing and the inductance of the auxiliary winding determines the predetermined ignition timing characteristics over the range of engine operating speeds.

While a preferred circuit configuration of the capacitor discharge ignition system of the present invention has been discussed hereinabove in connection with FIG. 4, it should be realized that the present invention can also be practiced with other specific circuit configurations including those of the prior art discussed in the Background section.

Figure 6:
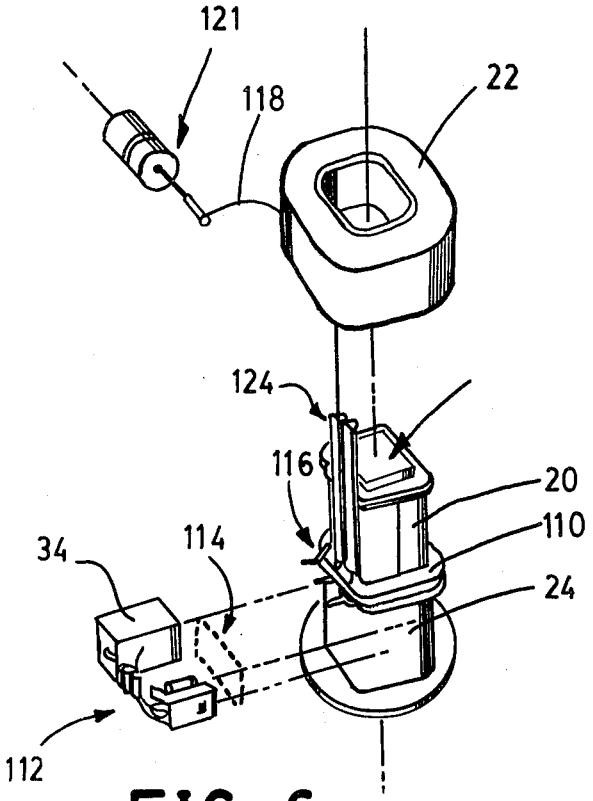
FIG. 6 is an exploded perspective view of the capacitor discharge ignition system of a preferred arrangement of the present invention of FIG. 3.
Figure 7:
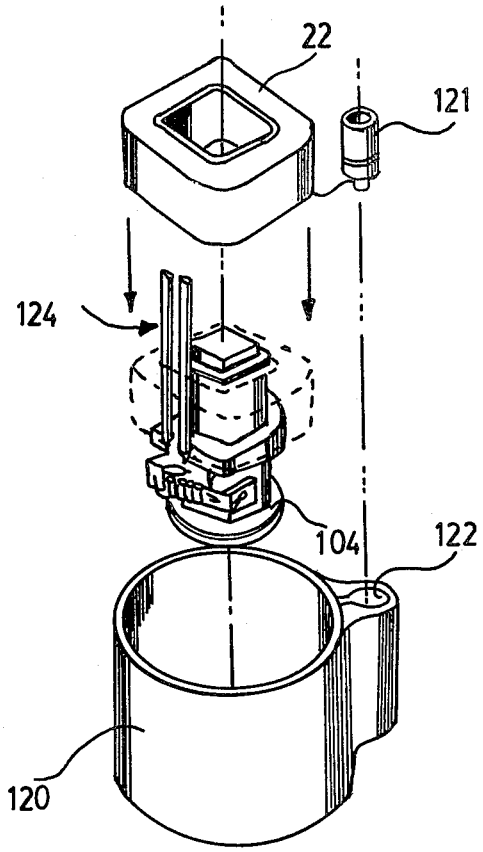
FIGS. 7 and 8 are additional perspective views of the capacitor discharge ignition system of FIGS. 3 and 6 showing various assembly steps and component arrangement.
Figure 8:
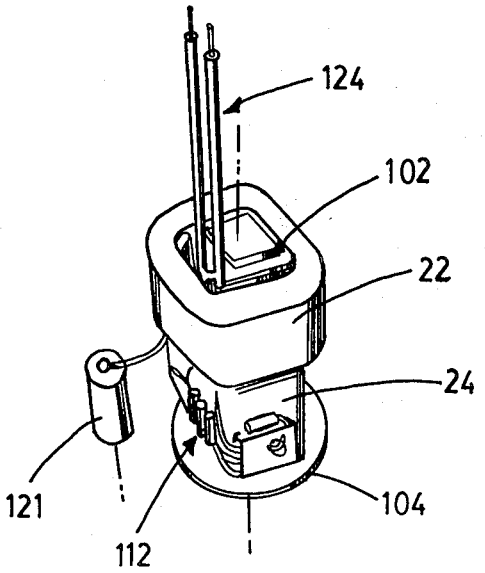
Figure 9:
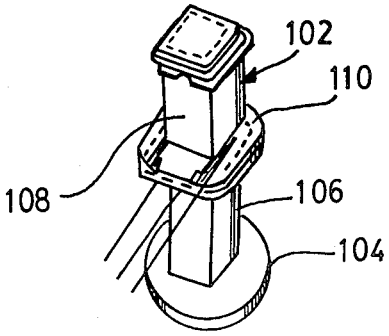
FIGS. 9 and 10 are perspective views of the coil support housing member of the capacitor discharge ignition system of FIGS. 6 through 8.
Figure 10:
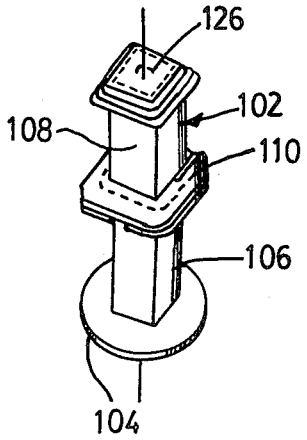

Referring now to FIGS. 6 through 10 and in accordance with a preferred embodiment of the present invention, the capacitor discharge ignition system 10 includes a coil support housing member 102 as best seen in FIGS. 9 and 10. The coil support housing member 102 includes a widened, circular base portion 104 and a generally square cross-sectioned upstanding position extending from the base 104. A first auxiliary support section 106 of the coil support housing member 102 extends upward from the base 104 and provides a bobbin onto which the auxiliary winding 24 is wound as shown in FIG. 6.

A primary support section 108 of the coil support housing member 102 extends above the auxiliary support section 106. The primary winding 20 of the ignition coil 18 is wound onto the primary support section 108 as shown in FIG. 6. The coil support housing member 102 is also fabricated with a widened platform section 110 that separates the auxiliary and the primary support sections 106 and 108, respectively. The platform 110 provides a reference stop and guide for the winding of the auxiliary winding 24 and the primary winding 20. The platform 110 also provides for the connection of the coil winding ends and the circuit connections and external connections of the capacitor discharge ignition system.

The circuitry components referred to generally at 112 in FIG. 6 including the circuitry components of FIG. 4 are assembled as a circuitry harness of interconnected components and positioned about the auxiliary winding 24 and within the vertical dimensions defined by the auxiliary support section 106. Alternatively, the circuitry components 112 are mounted on a small printed circuit board referred to at 114 in phantom in FIG. 6 with the overall assembly; the printed circuit board 114 with assembled components being mounted about the auxiliary winding 24.

The circuitry components 112 are interconnected with the coil ends and external connections of the capacitor discharge ignition system at the terminals referred to generally at 116 in FIG. 6. The secondary winding 22 of the ignition coil 18 is fabricated as a separate winding with the coil end 118 being suitably connected to a high tension output socket 121. In an alternative embodiment, the secondary winding 22 is wound in position about the primary winding 20 on the coil support housing member 102.

As shown in FIG. 7, the coil support housing member 102 with the affixed auxiliary winding 24, primary winding 20, secondary winding 22, and circuitry components 112 are positioned into a generally cup-shaped housing 120 of open cylindrical shape. The high tension output socket 121 is positioned within a receiving socket 122 fabricated in the housing 120. As will be explained in more detail hereinafter, the circular base 104 of the coil support housing member 102 is arranged to interfit in a frictional, snap-in relationship with the generally open bottom portion of the cylindrical housing 120. After the circuit components are mounted as hereinbefore described within the cylindrical housing 120, the entire assembly is potted by filling with a potting compound such as an epoxy filler to a point even with the top of the housing 120. Suitable external connections as generally indicated at 124 extend from the housing 120.

The complete assembly is disposed within the housing 120 as shown in FIG. 7. Referring again to FIG. 6 and the circuit components 112, the charging capacitor 34 and the SCR 58 are included in the circuitry components 112 along with the various other circuit components of FIG. 4. The circuitry components depicted as components 112 in FIG. 6 in addition to the charging capacitor 34 and the SCR 58 include the diodes 32, 64 and 66, and the resistors 60, 62 and 68.

Figure 1:
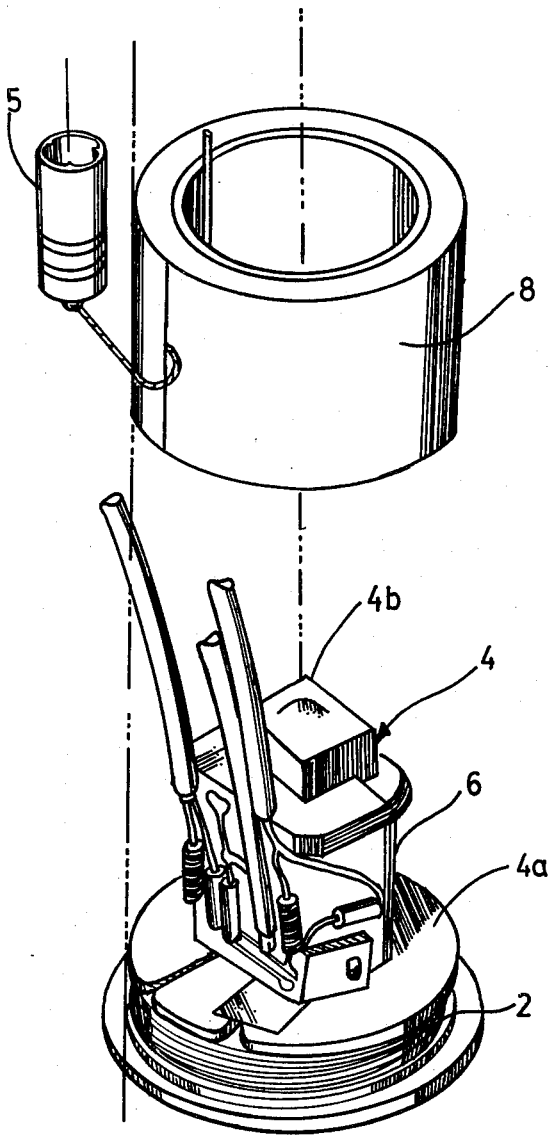
PRIOR ART FIG.1
FIGS. 1 and 2 are perspective views of a capacitor discharge ignition system of the prior art as discussed in the Background section.
Figure 2:
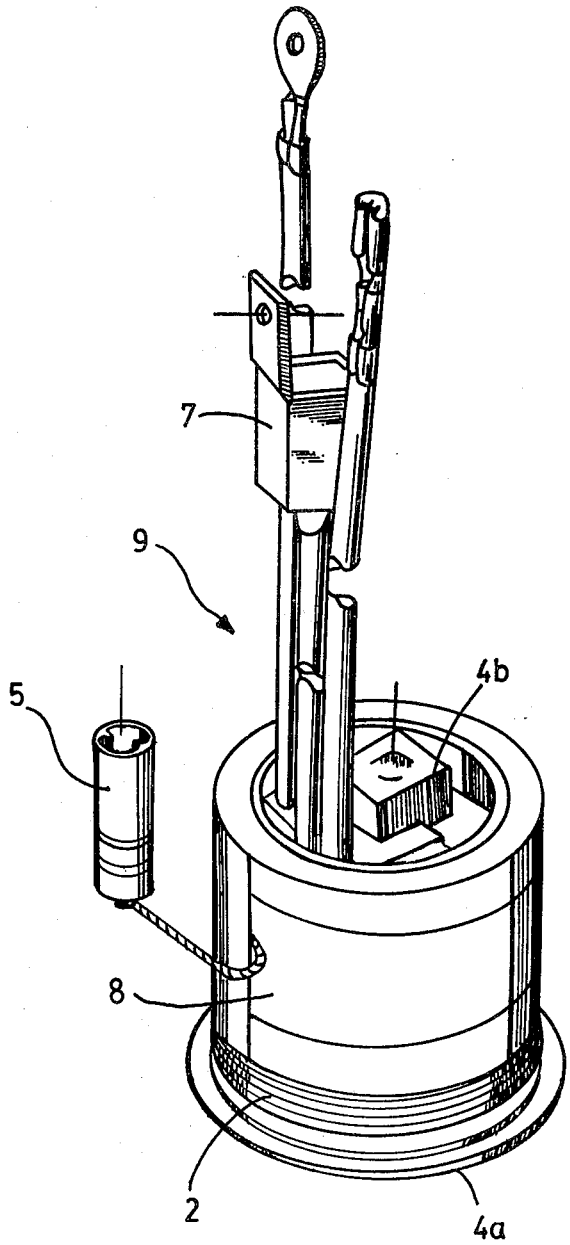
PRIOR ART FIG.2

In accordance with important aspects of the present invention and referring to FIGS. 6, 9 and 10, it should be noted that the relative dimensions of the auxiliary winding of the present invention are substantially smaller in diameter and greater in height than that of the prior art auxiliary winding illustrated in FIGS. 1 and 2. However, it should also be noted that the overall height dimension of the coil support housing member 102 is substantially the same as that in FIGS. 1 and 2 with the height of the primary and secondary windings 20 and 22 being reduced substantially. Further, the primary and secondary windings are fabricated with less coil wire than that of the primary and secondary windings in the ignition coil of FIGS. 1 and 2. The smaller dimensions of the ignition coil including primary and secondary windings 20 and 22 is accomplished by the removal of the circuitry components from the primary and secondary windings of FIGS. 1 and 2 and also due to the increased coupling that is achieved by the removal of the circuitry components.

Further, it should also be noted that the volumetric requirements and dimensions of the housing 120 of FIG. 7 are substantially similar to that of the housing to incorporate the capacitor discharge ignition system of FIGS. 1 and 2 in spite of the fact that the capacitor 34 is included within the housing 120 of the present invention while the capacitor denoted 7 in FIG. 2 is provided externally of the housing. Thus, this represents a net gain in packaging efficiency and volumetric usage of the housing 120 of the present invention as opposed to the prior art arrangement disclosed in FIGS. 1 and 2. Alternatively, the capacitor discharge ignition system of the present invention is fabricated with a smaller housing 120 of volumetric space than that which is possible with the system of the prior art in FIGS. 1 and 2 if the capacitor is mounted externally to the housing in FIG. 7.

It should also be noted that the provision of terminals 116 at the central platform section 110 of the coil support housing member 102 provide manufacturing and packaging efficiency as opposed to a terminal arrangement for the auxiliary, secondary and primary windings being disposed at the top of the coil support housing member 102. The external connections by means of the lead wires represented generally at 124 in FIGS. 6, 7 and 8 include a ground connection to the engine and a kill lead that is connected in the circuit configuration of FIG. 4 to short out or discharge the capacitor 34 to achieve a fast, reliable shutdown of the engine when desired.

After the capacitor discharge ignition assembly of FIG. 7 is positioned in the housing 120 and potted, the system is mounted on the core 14 in FIG. 3 with the core extending through a central opening 128 of the upstanding portions of the coil support housing member 102. The top section 126 of the coil support housing member 102 is fabricated to provide a quick and a reliable snap-out function for easy removal to allow the core 14 to pass through the coil support housing member 102.

Figure 11:
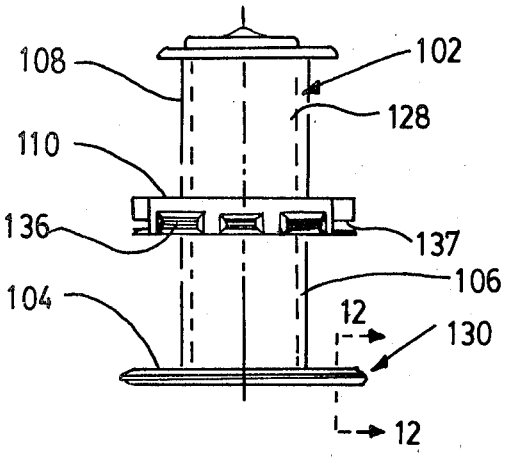
FIG. 11 is an enlarged elevational view of the coil support housing member of FIGS. 6 through 10.
Figure 12:
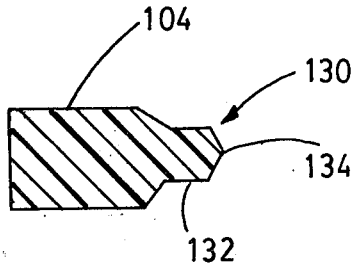
FIG. 12 is a sectional view of the coil support housing member taken along the line 12—12 of FIG. 11.
Figure 13:
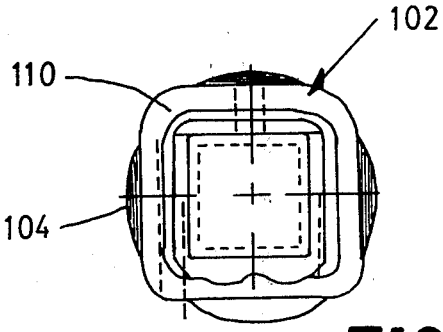
FIG. 13 is a plan view of the coil support housing member of FIG. 11.

Referring now additionally to FIGS. 11, 12 and 13, various structural details of the fabricated coil support housing member 102 are illustrated including the thin-walled, generally hollow construction of the upstanding portions of the coil support housing member 102. The core receiving passage 128 is shown in phantom in FIG. 11 and the snap-fit mechanism referred to generally at 130 in FIG. 11 is shown in detail in FIG. 12. The tapered lip 132 and the triangular cross-sectioned wedge 134 are fabricated along the circumference of the circular base 104 for a snap-fit assembly to the bottom circular opening of the housing 120 which also includes a suitable receiving socket construction.

The coil support housing member 102 is also fabricated with three terminal receiving sockets 136 for accepting and retaining the terminals referred to generally at 116 and FIG. 6. The platform section 110 between the auxiliary and primary support sections 106 and 108 is also fabricated with receiving grooves 137 for the routing of the coil wire ends for easy assembly.

Figure 15:
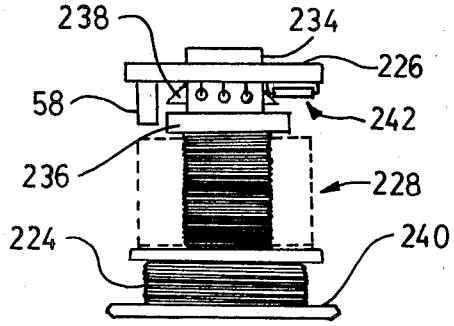
FIG. 15 is an elevational representation of the component relationships of the assembled capacitor discharge ignition system of FIG. 14.
Figure 14:
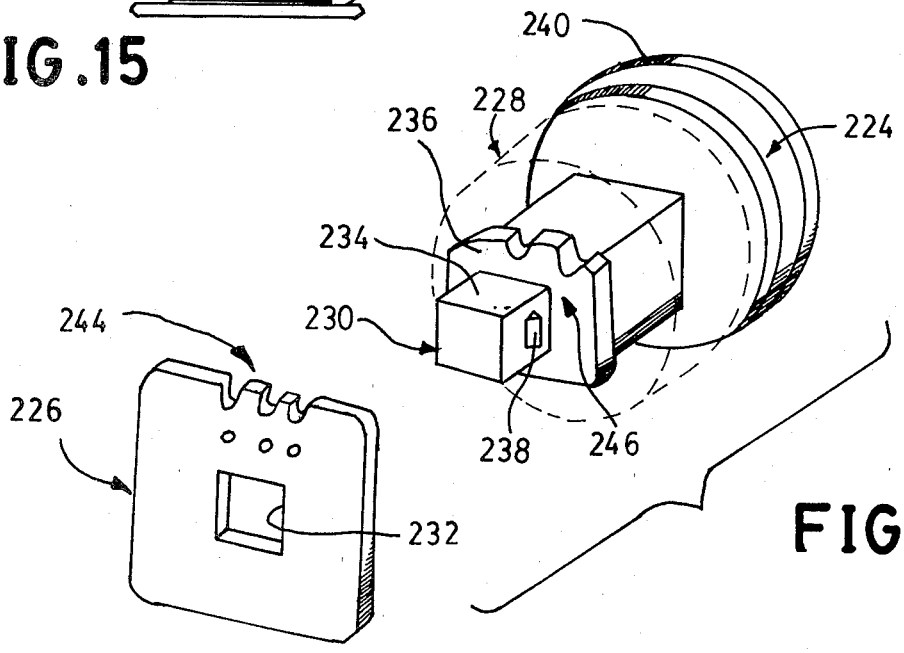
FIG. 14 is an exploded perspective view of an alternate arrangement of the capacitor discharge ignition system of the present invention illustrated in FIG. 3.

Referring now to FIGS. 14 and 15, an alternative embodiment of the present invention is illustrated wherein the auxiliary winding 224 is substantially similar to that of the prior art auxiliary winding of FIGS. 1 and 2 having a relatively large diameter and narrowed height factor. In the alternative arrangement of FIGS. 14 and 15, packaging efficiency is achieved by the removal of the circuitry components from the position in FIGS. 1 and 2 between the primary and secondary windings and positioned on a printed circuit board 226.

Thus, in the alternative embodiment of FIGS. 14 and 15, the ignition coil 228 including the primary and secondary windings are fabricated with reduced coil wire lengths and volumetric space as compared to that of the ignition coil including primary and secondary windings 6 and 8 of FIGS. 1 and 2. Thus, the coil support housing member 230 of FIGS. 14 and 15 is fabricated having an auxiliary coil support section substantially equal to that as shown in FIGS. 1 and 2 and a primary and secondary coil support section substantially reduced from that of FIGS. 1 and 2. The printed circuit card 226 by means of a central aperture 232 and with the mounted circuit components is positioned over the narrow upstanding section 234 of the coil support housing member 230. Thus, in the assembled capacitor discharge ignition system, the circuitry components in the assembled position are disposed between the attached printed circuit card 226 and the ignition coil 228. The coil support housing member 230 is fabricated with the narrowed extending portion 234 atop the auxiliary and ignition coil support sections extending above a widened flange portion 236.

The narrowed top portion 234 includes extending wedge members 238 having a ramp surface for retention of the attached printed circuit card 226. The circular base section of the coil support housing member 230 is referred to generally at 240 in FIG. 14.

Referring now specifically to FIG. 15, a representation of the assembled capacitor discharge ignition components of the alternative embodiment is illustrated with various circuit components 242 including the SCR 58 extending from the printed circuit card 226 in the vicinity of the ignition coil 228. In FIG. 15, the secondary winding of the ignition coil 228 is shown in phantom and the primary winding of the ignition coil 228 is visible. The printed circuit card 226 as seen in FIG. 14 includes connection arrangements generally referred to at 224 for the connection of external wire leads and for accepting coil winding leads protruding through sections 246 of the coil support housing member platform 236 for ease of manufacture.

Thus, in the alternative arrangement of FIGS. 14 and 15, packaging efficiency is achieved with a reduced wire content of the ignition coil 228 by the removal of the circuitry components from a location between the primary and secondary windings of the ignition coil. Accordingly, the height of the ignition coil 228 is reduced from that of the ignition coil components in FIGS. 1 and 2. The height factor and volumetric space gained as a result of the removal of these components allows space for the printed circuit card 226 and the associated circuitry components for positioning in a housing that is similar to the housing 120 of FIG. 7 atop the ignition coil 228. Thus, the overall dimensions of the housing to incorporate the capacitor discharge ignition system of FIG. 14 is substantially similar to that of the housing to incorporate the prior art arrangement of FIGS. 1 and 2.

Ease of manufacture is obtained by the arrangement of FIGS. 14 and 15 by allowing the automated or semi-automated mounting of the circuitry components on the printed circuit card 226 and ease of assembly of the overall capacitor discharge ignition system. The further cost reduction of the overall capacitor discharge ignition system is also made possible by the reduction of the wire content of the ignition coil 228. As determined by the size of the charging capacitor 34 of FIG. 4, and the desired volumetric dimensions of the housing to incorporate the capacitor discharge ignition system of FIGS. 14 and 15, the capacitor 34 may be mounted either within the housing with the circuitry components 242 on the printed circuit card 226 or alternatively may be positioned directly atop the printed circuit card 226 and potted therewith during the potting phase to complete the capacitor discharge ignition system after mounting in the housing. In another alternative arrangement, the capacitor 34 may be mounted externally by means of an external connection.

In a specific embodiment of the CDI system of FIGS. 3 through 13, the following parameters have been found suitable and should not be interpreted in any listing sense (in inches unless otherwise noted):

| | |
|---|---|
| Auxiliary Winding 24; | |
| maximum overall wind dimensions (as measured in a direction across the flat surfaces of the coil support housing member 102); | .600 |
| approximate height; | .435 |
| wire size; | 38 GA. |
| number of turns; | 1600–1900 turns |
| Primary Winding 20; | |
| approximate height; | .450 |
| wire size; | 25 GA. |
| number of turns; | 45 turns |
| Secondary Winding 22; | |
| approximate height; | .400 |
| wire size; | 44 GA. |
| number of turns; | 6000 turns |
| maximum overall diagonal winding dimension; | 1.200 |
| Output at 30; | 25 KV |
| Secondary to Primary Turns Ratio; | 133 |

The parameters hereinbefore set forth for a specific embodiment of the present invention are useful for comparison purposes to the parameter of a CDI system of the type illustrated in FIGS. 1 and 2 and intended for the same engine application as follows:

| | |
|---|---|
| Auxiliary Winding 2; | |
| maximum overall wind dimension (as measured in a direction across the flat surfaces of the coil support 4); | 1.00 |
| approximate height; | .210 |
| wire size; | 35 GA. |
| number of turns; | 1600 turns |
| Primary Winding 6; | |
| approximate height; | .600 |
| wire size; | 24 GA. |
| number of turns; | 50 turns |
| Secondary Winding 8; | |
| approximate height; | .600 |
| wire size; | 43 GA. |
| number of turns; | 7500 turns |
| maximum overall diagonal winding dimension; | 1.300 |
| Output at 30 in Same Circuit of FIG. 4; | 21–22 KV |
| Secondary to Primary Turns Ratio; | 150 |

The dimensions of the housing 120 for incorporation of the component assemblies set forth hereinbefore are an internal housing diameter of approximately 1.400 inches and an internal height of approximately 1.000 inches.

The efficiency in coupling in the ignition coil gained by the component placement in the present invention around the auxiliary winding 24 is illustrated by the reduction in required turns ratio from 150 between the windings 6 and 8 to 133 between the windings 20 and 22 while the output at 30 is increased from 21 or 22 KV to 25 KV. The auxiliary winding 24 as discussed hereinbefore also provides increased coupling to the core 14 and linkage between turns and reduced leakage flux effects.

Further, the decreased height of the primary winding 20 and the secondary winding 22 provides better coupling of the windings due to the decrease in the mean winding distance of each of the coils from the bight of the U of the core 14 and the increased proximity to the major portion of the core 14.

The cost reduction in manufacture of the CDI system 10 of FIGS. 3 through 13 as compared to the CDI system of FIGS. 1 and 2 is exhibited in a reduction of labor cost and a reduction in component costs. The reduced wire content of the primary and secondary windings 20 and 22 provides a direct component cost reduction. Further, the ease of assembly; precision of component placement; ease of troubleshooting, testing and replacement of components are greatly improved by the CDI system 10. For example, the packaging efficiency of the CDI system 10 provides for the integration of the capacitor 34 in the housing 120 as a result of the net volume gained within the housing 120. This is in comparison to the CDI system of FIGS. 1 and 2 wherein the capacitor 7 must be sealed in a separate operation or purchased at an increased cost as a potted or sealed component for reliability. Further, the component and labor costs are greater if the capacitor 7 is external to the housing 120.

Figure 16:
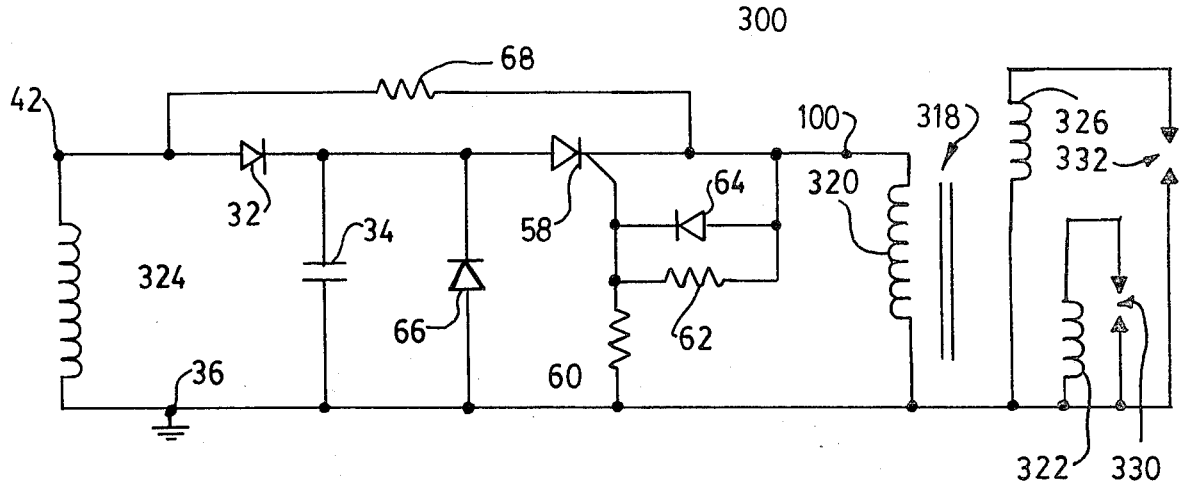
FIG. 16 is an electrical schematic diagram of one preferred circuit arrangement of the capacitor discharge ignition system embodying the concepts of the present invention produces with a dual secondary ignition coil for two cylinder engine operation.
Figure 18:
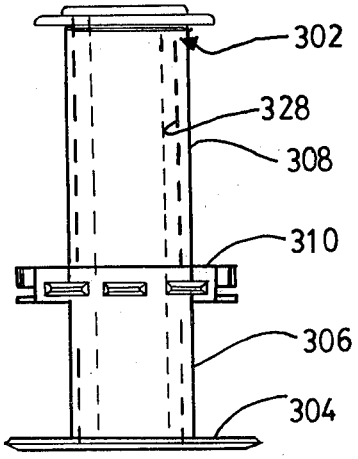
FIG. 18 is an enlarged elevational view of the coil support housing member of the capacitor discharge ignition system of FIGS. 16 and 17.
Figure 17:
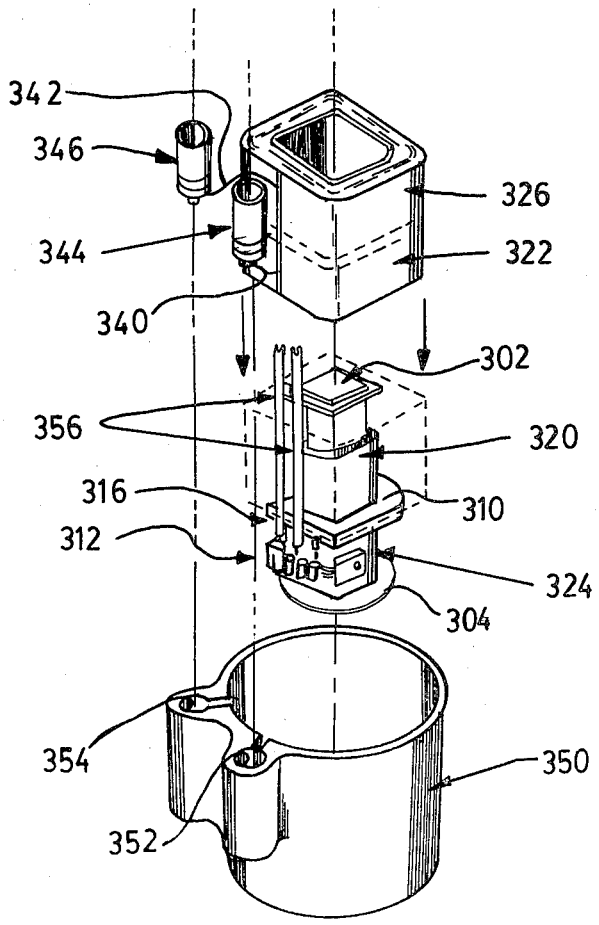
FIG. 17 is an exploded perspective view of the capacitor discharge ignition system of the present invention of FIG. 16 provided with a dual secondary ignition coil for two cylinder engine operation.

Referring now to FIGS. 16 through 18, an embodiment of the present invention is illustrated for two cylinder engine operation. Specifically, and referring to FIG. 16, the ignition coil 318 of the capacitor discharge ignition system 300 includes a primary winding 320 and two secondary windings 322 and 326. Further, the auxliary winding 324 is of a similar shape factor to the auxiliary winding 24 but includes a larger number of turns than the auxiliary winding 24 of FIG. 4 to provide a suitable charging source for the dual secondary ignition coil capacitor discharge ignition system. The remaining circuit components of the dual secondary ignition coil capacitor discharge ignition system of FIG. 16 correspond to like numbered circuit components of the capacitor discharge ignition system of FIG. 4 discussed hereinbefore.

The operation of the dual secondary ignition coil capacitor discharge ignition system 300 of FIG. 16 is substantially identical in most respects to that of the capacitor discharge ignition system of FIG. 4. However, the dual secondary ignition coil capacitor discharge ignition system 300 is arranged to operate adjacent a flywheel of a two cylinder, two cycle engine; the flywheel being similar to the flywheel 12 of FIG. 3 but additionally including a second permanent magnet in addition to the magnet 15. The additional magnet is arranged on the flywheel at a position that is approximately 180° opposite to that of the magnet 15.

The dual secondary windings 322 and 326 are each respectively connected at 330 and 332 to fire a respective spark plug of each cylinder connected at 330 and 332 respectively.

During operation of the dual secondary ignition coil capacitor discharge ignition system 300, the high voltage output firing pulses across the dual secondary windings 322 and 326 occur simultaneously with two firing pulses being generated for each revolution of the engine flywheel. Thus, with the two cylinders of the engine being 180° out of phase, the spark plug associated with each cylinder receives a firing pulse during the compression cycle and during the exhaust cycle for each revolution of the engine flywheel. As the first magnet passes the capacitor discharge ignition system 300, a first of the cylinders receives a firing pulse during the compression cycle and the second cylinder receives a firing pulse during the exhaust cycle. As the second magnet passes the capacitor discharge ignition system 300, the first cylinder receives a firing pulse during the exhaust cycle and the second cylinder receives a firing pulse during the compression cycle.

Referring now to FIGS. 17 and 18, the dual secondary ignition coil capacitor discharge ignition system 300 includes a coil support housing member 302 similar in construction to the coil support housing member 102 of FIGS. 9 through 13. The coil support housing member 302 includes a widened circular base portion 304 and a generally square cross-sectioned upstanding portion extending from the base 304. A first auxiliary support section 306 extends upward from the base 304 and provides a bobbin onto which the auxiliary winding 324 is wound as shown in FIG. 17.

A primary support section 308 of the coil support housing member 302 extends above the auxiliary support section 306. The primary winding 320 of the ignition coil 318 is wound onto the primary support section 308 as shown in FIG. 17. The coil support housing member 302 is also fabricated with a widened platform section 310 that separates the auxiliary and the primary support sections 306 and 308, respectively. The platform 310 provides a reference stop and guide for the winding of the auxiliary winding 324 and the primary winding 320. The platform 310 also provides for the connection of the coil winding ends and the circuit connections and external connections of the capacitor discharge ignition system.

Thus, the coil support housing member 302 is generally similar to the coil support housing member 102. However, the primary support section 308 of the coil support housing member 302 is fabricated with suitable dimensions to provide for the dual secondary windings 322 and 326 as shown in FIG. 17.

The circuitry components referred to generally at 312 in FIG. 17 including the circuitry components of FIG. 16 are assembled as a circuitry harness of interconnected components and positioned about the auxiliary winding 324 and within the vertical dimensions defined by the auxiliary support section 306. Alternatively, the circuitry components 312 are mounted on a small printed circuit board as shown in FIG. 6 with the overall assembly; the printed circuit board with assembled components being mounted about the auxiliary winding 324.

The circuitry components 312 are interconnected with the coil ends and external connections of the capacitor discharge ignition system at the terminals referred to generally at 316 in FIG. 17. The secondary windings 322 and 326 of the ignition coil 318 are fabricated as a separate winding assembly with the respective coil ends 340 and 342 being suitably connected to respective high tension output sockets 344 and 346. In an alternative embodiment, the secondary windings 322 and 326 are wound in position about the primary winding 320 on the coil support housing member 302.

As shown in FIG. 17, the coil support housing member 302 with the affixed auxiliary winding 324, the primary winding 320, the secondary windings 322 and 326, and the circuitry components 312 are positioned into a generally cup-shaped housing 350 on open cylindrical shape. The high tension output sockets 344, 346 are positioned within respective receiving sockets 352, 354 that are integrally fabricated in the housing 350. After the circuit components are mounted as hereinbefore described within the cylindrical housing 350, the entire assembly is potted by filling with a potting compound such as an epoxy filler to a point even with the top of the housing 350. Suitable external connections as generally indicated at 356 extend from the housing 350.

The complete assembly is disposed within the housing 350 as generally illustrated by the embodiment of FIG. 8. Referring again to FIG. 17 and the circuit components 312, the charging capacitor 34 and the SCR 58 are included in the circuitry components 312 along with the various other circuit components of FIG. 16. The circuitry components depicted as components 312 in FIG. 17 in addition to the charging capacitor 34 and the SCR 58 include the diodes 32, 64 and 66, and the resistors 60, 62 and 68.

After the capacitor discharge igniton assembly of FIG. 17 is positioned within the housing 350 and potted, the system is mounted on the core 14 of FIG. 3 with the core extending through a central opening 328 of the upstanding portion of the coil support housing member 302.

In a specific embodiment of the CDI system 300 of FIGS. 16 through 18, the following parameters have been found suitable although they should not be interpreted in any limiting sense (in inches unless otherwise noted):

| | |
|---|---|
| Auxiliary Winding 324 | |
| maximum overall wind dimensions (as measured in a direction across the flat surfaces of the coil support housing member 302); | .600 |
| approximate height; | .435 |
| wire size; | 40 GA. |
| number of turns; | 3000 turns |
| Primary Winding 320 | |
| approximate height; | .600 |
| wire size; | 23 GA. |
| number of turns; | 45 turns |
| Secondary Windings 322, 326 | |
| approximate height (each); | .400 |
| wire size; | 44 GA. |
| number of turns; | 6000 turns |
| maximum overall diagonal winding dimension; | 1.200 |
| Output at 330, 332; | 23 KV |
| Secondary to Primary Turns Ratio; | 133 |

The dimensions of the housing 350 for incorporation of the component assemblies set forth hereinbefore are an internal housing diameter of approximately 1.400 inches and an internal height of approximately 1.5 inches.

The packaging and manufacturing efficiencies of the dual secondary ignition coil CDI system 300 are similar to those as discussed hereinbefore in connection with the CDI system 10 of FIGS. 6 through 13.

The primary winding 320 of the capacitor discharge ignition system 300 as illustrated in FIG. 17 extends along the primary support section 308 from the platform section 310 of the coil suport housing member 302 over the height dimension 0.600 inches of the primary winding 320. Thus, the secondary winding 322 over its total height of 0.400 inches is completely contiguous with the primary winding 320. Approximtely one-half of the height of the secondary winding 326 is contiguous with the primary winding 320 and the other approximate half of the secondary winding 326 extends above the primary winding 320. This configuration is utilized to balance the outputs of the secondary winding 322, 326 at 330, 332 respectively since the uppermost secondary winding 326 would ordinarily generate a higher output than the lowermost secondary winding 322 due to the closer proximity of the uppermost secondary winding 326 to the bight of the core 14.

In an alternative embodiment, the primary winding 320 is fabricated to extend over the extent of both secondary windings 322, 326 with 45 turns of 21 gauge wire. However, this arrangement yields unequal outputs at 330, 332 and is not preferred where balanced output voltages are desired.

While there has been illustrated and described various embodiments of the present invention, it will be apparent that various changes and modifications will occur to those skilled in the art. It is intended in the appended claims to cover all such changes and modifications as fall within the true spirit and scope of the present invention.

What is claimed and desired to be secured by Letters Patent of the United States is:

1. In a capacitor discharge ignition system for use with and positioned adjacent a rotating magnetic field in synchronism with the operation of an engine engine, a capacitor discharge ignition sub-assembly for mounting on a ferromagnetic core, the capacitor discharge ignition subassembly comprising:

an auxiliary coil;

an ignition transformer including a primary coil and secondary coils;

a coil support member, said auxiliary coil and said primary and second coils being concentrically disposed on said coil support member;

a housing for receiving and enclosing said auxiliary coil, said ignition coil and said circuitry means; and a printed circuit card having disposed thereon said electrical circuitry means, said printed circuit card having a central aperture arranged to interfit with a portion of said coil support member, said coil support member being a generally upstanding elongated member, said auxiliary coil being disposed about a first portion of said coil support member, said ignition coil being disposed about a second portion of said coil support member adjoining said first portion, and said printed circuit card being disposed on said coil support member adjacent said second portion of said coil support member and said ignition coil, said coil support member comprising a third portion extending from said second portion, said third portion interfitting with said central aperture of said printed circuit card, said first, second and third portions being generally aligned along a central axis of said coil support member, said printed circuit card including said electrical circuitry means being disposed on one side thereof, said printed circuit card being disposed on said third portion with said one side of said printed circuit card facing toward said first and second portions.

2. In a capacitor discharge ignition system for use with and positioned adjacent a rotating magnetic field in synchronism with the operation of an engine, a capacitor discharge ignition sub-assembly for mounting on a ferromagnetic core, the capacitor discharge ignition sub-assembly comprising:

an auxiliary coil;

an ignition transformer including a primary coil and secondary coils;

a coil support member, said auxiliary coil and said primary and secondary coils being concentrically disposed on said coil support member;

electrical circuitry means interconnecting said auxiliary coil and said primary coil and being responsive to said auxiliary coil for providing energy to said primary coil in response to induced electrical energy in said auxiliary coil as a result of the rotating magnetic field;

a housing for receiving and enclosing said auxiliary coil, said ignition coil and said circuitry means; and a printed circuit card having disposed thereon said electrical circuitry means, said printed circuit card having a central aperture arranged to interfit with a portion of said coil support member, said coil support member being a generally upstanding elongated member, said auxiliary coil being disposed about a first portion of said coil support member, said ignition coil being disposed about a second portion of said coil support member adjoining said first portion, and said printed circuit card being disposed on said coil support member adjacent said second portion of said coil support member and said ignition coil, said coil support member comprising a third portion extending from said second portion, said third portion interfitting with said central aperture of said printed circuit card, said first, second and third portions being generally aligned along a central axis of said coil support member, said third portion of said coil support member being fabricated with a predetermined cross-section to interfit with said central aperture, said central aperture having the same general shape as said predetermined cross-section of said third portion, said third portion of said coil support member comprising engagement means for engaging said printed circuit card upon positioning of said printed circuit card onto said third portion and defining a predetermined assembly position of said printed circuit card along said third portion in the direction of said coil support member axis, said engagement means comprising wedge members extending from at least two locations along said third portion, said wedge members extending generally perpendicular to said coil support member axis.

3. The capacitor discharge ignition sub-assembly of claim 2 wherein said wedge members include a ramp surface forming a predetermined angle with respect to the central axis of said coil support member axis, said aperture of said printed circuit card having a predetermined cross-section larger than the cross-section of said third portion, said printed circuit card engaging said ramp surfaces when said printed circuit card is positioned to said predetermined assembly position.

4. The capacitor discharge ignition sub-assembly of claim 1 wherein said third portion of said coil support member is fabricated with a predetermined cross-section to interfit with said central aperture, said central aperture having the same general shape as said predetermined cross-section of said third portion.

5. The capacitor discharge ignition sub-assembly of claim 4 wherein said third portion of said coil support member comprises engagement means for engaging said printed circuit card upon positioning of said printed circuit card onto said third portion and defining a predetermined assembly position of said printed circuit card along said third portion in the direction of said coil support member axis.

6. The capacitor discharge ignition sub-assembly of claim 5 wherein said engagement means comprises wedge members extending from at least two locations along said third portion, said wedge members extending generally perpendicular to said coil support member axis.

7. The capacitor discharge ignition sub-assembly of claim 6 wherein said wedge members include a ramp surface forming a predetermined angle with respect to the central axis of said coil support member axis, said aperture of said printed circuit card having a predetermined cross-section larger than the cross-section of said third portion, said printed circuit card engaging said ramp surfaces when said printed circuit card is positioned to said predetermined assembly position.

8. The capacitor discharge ignition sub-assembly of claim 4 wherein said predetermined cross-section of said third portion is a quadrilateral.

9. The capacitor discharge ignition sub-assembly of claim 4 wherein said third portion has a smaller cross-section than said first and second portions.

10. The capacitor discharge ignition sub-assembly of claim 1 wherein each of said first, second and third portions of said coil support member is fabricated with a predetermined cross-section, said coil support member further including a widened base section at the end of said first portion distant said section portion, a first widened platform at the juncture of said first and second portions, and a second widened platform at the juncture of said second and third portions.

* * * * *